United States Patent [19]

Boggs

[11] Patent Number: 4,637,286

[45] Date of Patent: Jan. 20, 1987

[54] STAPLE CUTTING FOR FIBER REINFORCEMENT MATERIAL

[75] Inventor: Beryl A. Boggs, Richmond, Va.

[73] Assignee: Allied Corporation, Morris Township, Morris County, N.J.

[21] Appl. No.: 794,365

[22] Filed: Nov. 4, 1985

Related U.S. Application Data

[63] Continuation-in-part of Ser. No. 633,835, Jul. 24, 1984, abandoned.

[51] Int. Cl.[4] ..... D01G 1/04

[52] U.S. Cl. ..... 83/175; 83/347; 83/913; 225/97

[58] Field of Search ..... 83/18, 115–117, 83/175, 176, 347, 913; 225/97, 103–105; 30/128, 180

[56] References Cited

U.S. PATENT DOCUMENTS 3,063,608 11/1962 Hupp ..... 225/97

3,103,304 9/1963 Nawalanic ..... 225/97 X

FOREIGN PATENT DOCUMENTS 521270 4/1977 U.S.S.R. ..... 83/913

*Primary Examiner*—James M. Meister

[57] ABSTRACT

Method and apparatus for cutting elongated material into short lengths is provided. The method features the steps of compressing the elongated material at discrete intervals transversely; slightly tensioning the elongated material along its length between intervals; pressing the slightly tensioned elongated material between intervals against a cutting edge; and cutting the elongated material with the cutting edge. The apparatus features a pair of cooperating rolls rotating in opposite directions and between which the elongated material passes. The cutting roll has a plurality of radially extending cutting blades as well as a plurality of radially extending projections, at least one of the projections being located on each side of a cutting blade and extending further radially from the cutting roll than the blades. The second roll is formed of an elastic material and is engaged by the projections in succession to compress the elongated material therebetween.

11 Claims, 6 Drawing Figures

STAPLE CUTTING FOR FIBER REINFORCEMENT MATERIAL

BACKGROUND OF THE INVENTION

1. Field of the Invention

This is a continuation-in-part of application Ser. No. 633,835 filed July 24, 1984, now abandoned.

This invention relates to a method and apparatus for cutting elongated material into shorter lengths having predetermined dimensions. More particularly, this invention relates to a method of cutting fiber, preferably continuous filament, into shorter lengths for use as reinforcement in plastic products. The preferred elongated material of the present invention is continuous filamentary material, preferably of polyester, nylon, Kevlar®, fiberglass, etc.; elongated material may equally be applicable to strips, ribbons, tapes, film, wire or any other flexible material.

2. The Prior Art

In the current practice of forming a sheet for molding of plastic products such as hard hats, automotive parts, etc., glass fibers are fed from a creel package to a cutter mechanism which chops the fiberglass into staple lengths for gravity feed into a resin paste passing thereunder, usually on a conveyor belt. The cutter mechanism includes cutting blades rotated against a polyurethane covered roll and between which the fiberglass is passed to be cut or broken into lengths corresponding to the spacing of the cutting blades. The design has not proved satisfactory in cutting less brittle materials such as polyester yarn. The present invention is intended to allow elongated materials to be cut into staple lengths for inclusion in a sheet of molding composition which subsequently will be molded into a plastic product.

A portable device adapted to break fibers into short lengths and to direct the same onto a surface being coated is disclosed in U.S. Pat. No. 3,011,257 to Bamberger, hereby incorporated by reference. Glass rovings are continuously drawn into the bite of oppositely turning rollers, one of which has circumferentially spaced chopping bars thereon which engage the other roller and breaks the fiber into short sections when passed therebetween.

Many other types of cutting devices and methods for dividing elongated material into shorter lengths are known. Specifically, reference should be had to U.S. Pat. Nos. 3,485,120 to Keith, 3,733,945 to Cook, 4,120,222 to Potter and 4,300,422 to Potter, all of which are hereby incorporated by reference. All of these cutters are broadly used for cutting tow of very high denier into staple length fibers. The cutter of the Keith patent includes a rotatable reel having outwardly facing cutting blades against which the tow is wound; a fixed pressure roller pressing upon the tow wound around the reel results in cutting of the innermost layers of tow by the cutting blade. As cutting progresses a wad of cut staple fibers is forced inwardly between adjacent pairs of blades. The other patents are directed to modifications of the Keith apparatus for removal of the cut fibers.

U.S. Pat. Nos. 3,942,401 and 3,945,280 to Roncato, both of which are hereby incorporated by reference, teach a method and apparatus for cutting thread which includes a rotating drum carrying a plurality of radially extending cutting blades operating in conjunction with a rotating support drum which carries and supports the thread. Ejector elements carried by the cutting drum and positioned in the spaces between the cutting blades are urged radially outwardly by centrifugal force and compress the thread against the surface of the support drum. Compression of the thread is continuous, both transversely and along its length.

U.S. Pat. No. 3,118,336 to Hampshire, hereby incorporated by reference, teaches a fiber cutter which includes a pair of rolls having resilient covers, means rotatably mounting the rolls on parallel axes and in pressure engagement with each other to flatten the rubber covers of the rolls against each other, means for passing a strand between the rolls to hold the strand firmly between the flattened covers, and at least one knife blade carried by a roll and normally surrounded by and circumferentially supported by the resilient cover. The blade is supported against radial deflection and becomes exposed between the flattened covers to cut the firmly held strand. The strand is in a state of continuous compression until cut.

U.S. Pat. No. 4,406,196 to Roncato et al., hereby incorporated by reference, teaches yet another device for cutting thread wherein the device has a first rotatable smooth faced drum and a second rotatable blade bearing drum with a plurality of radially extending circumferentially spaced cutting blades on the outer periphery thereof. Centrifugal force responsive means comprising fins connected to a deformable ring are positioned between the blades, and on rotation of the drums act to press a thread onto the smooth faced drum, i.e., to put the thread under continuous compression.

U.S. Pat. No. 3,426,632 to Ahles et al., hereby incorporated by reference, also teaches a staple cutter which includes a pair of rotatable, contiguous tow-clamping disks, having affixed at their peripheries a series of flanged teeth in abutting relationship adapted to grip and advance tow therebetween, and a rotatable cutting member or flying-knife cutter synchronized to pass through or cut tow and pass between pairs of the abutting teeth.

SUMMARY OF THE INVENTION

A method and apparatus for cutting elongated material into short lengths is provided. The method comprises the steps of: compressing the elongated material at discrete intervals transversely, slightly tensioning the elongated material along its length between intervals, pressing the slightly tensioned elongated material between intervals against a cutting edge, and cutting the elongated material with the cutting edge. It is preferred that the cutting blades be mounted in a spaced relationship and define a closed geometrical figure, the cutting blades being rotated as a unit.

The present invention also provides an improved apparatus for cutting elongated material into predetermined lengths. The apparatus comprises a rotatable cutting roll having a plurality of radially extending cutting blades, and a cooperating second roll. The rolls rotate in opposite directions with the elongated material passing therebetween. The improvement comprises forming at least a coating of the second roll of an elastic material and providing the cutting roll with a plurality of projections radially extending therefrom circumferentially. At least one of the projections is located on each side of a cutting blade and extends further radially from the normal periphery of the cutting roll than the blades. The coating of the second roll is engaged by the projections in succession to compress the elongated material therebetween.

The projections adjacent each blade must be sufficiently close to the blade to achieve compression of the yarn by both projections with the pressure roll (second roll) simultaneously. For cutting rolls having a diameter of about 1 to 2 inches (5 to 10 cm), and wherein the pressure roll has an equivalent diameter, at least two of the projections are preferably located on each side of a cutting blade and extend further radially from the normal periphery of the cutting roll than the blades.

The present invention also provides apparatus for cutting elongated material into short lengths which comprises: means for compressing the elongated material at discrete intervals, means for tensioning the elongated material between the intervals, and means for pressing the slightly tensioned elongated material between intervals against a cutting edge to ultimately cut the elongated material therewith.

DESCRIPTION OF THE PREFERRED EMBODIMENT

Figure 1:
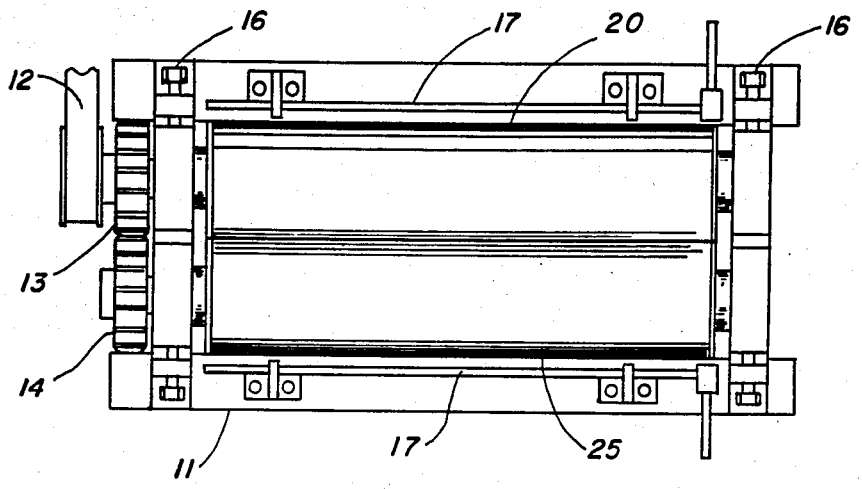
FIG. 1 is a plan view of the cutter 10 of the present invention, without a cover or guide system.
Figure 2:
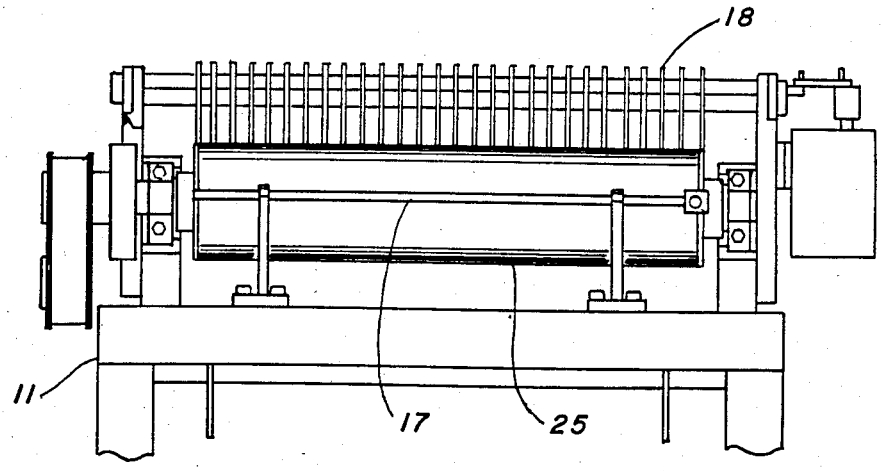
FIG. 2 is a front view of cutter 10 with guide system 18.
Figure 3:
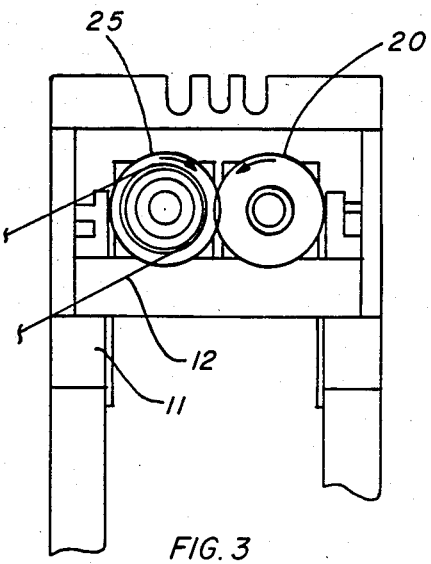
FIG. 3 is an end view of cutter 10.

In the accompanying drawings like numbers indicate like apparatus. With reference to FIGS. 1–3, the cutter 10, preferably for use in an SMC or sprayup system, comprises cutting roll 20 and pressure roll 25, mounted in parallel with respect to their longitudinal axes in a frame 11 for rotation in opposite directions (see arrows in FIGS. 3 and 4). Frame 11 is designed to leave the area beneath the cutting zone defined between rolls 20 and 25 open for the horizontal passage of a conveyor belt. Cut staple lengths fall (by gravity) into a sheet of resin paste on the conveyor belt (unshown).

Any conventional drive system for rolls 20 and 25 is suitable. In the preferred system, a motor (unshown) drives the shaft of cutting roll 20 via timing belt 12 with associated timing pulleys. Spur gear 13, which is keyed to the shaft of cutting roll 20, rotates with the shaft to drive spur gear 14, which is keyed to the shaft of pressure roll 25. This causes rotation of pressure roll 25. Obviously, the shaft of pressure roll 25 could be driven by timing belt 12 to in turn drive spur gear 13 for rotation of cutting roll 20.

Figure 4:
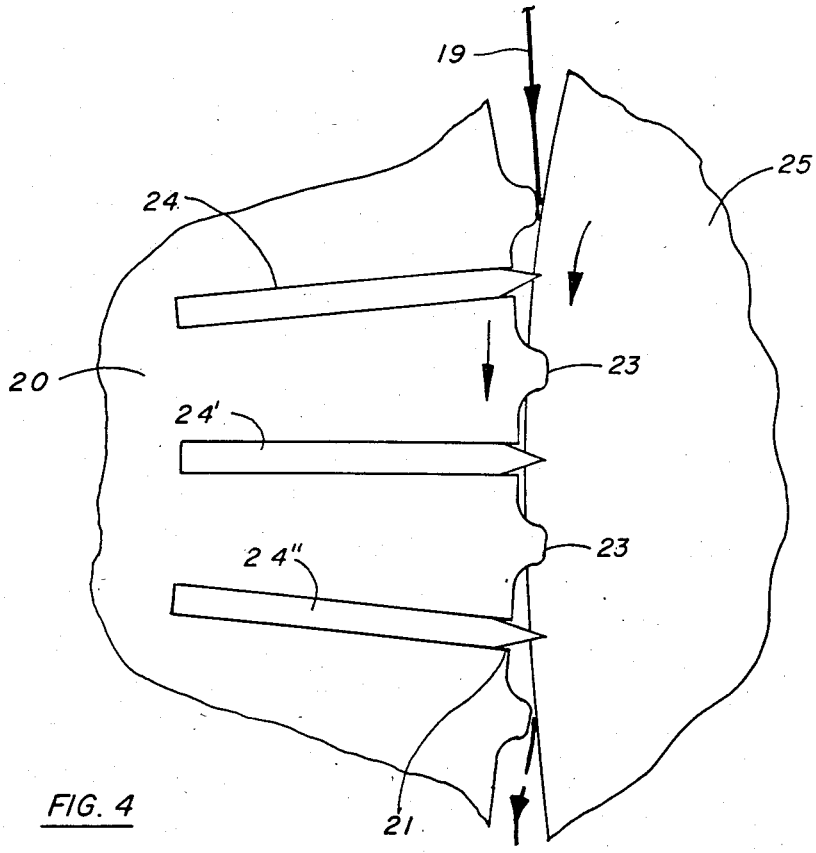
FIG. 4 is a detailed sectional view of cooperating cutting roll 20 and pressure (backup) roll 25.

Cutting roll 20 has a plurality of radial slots 21 therein which extend longitudinally and receive cutting blades 24. Blades 24 are held in place by a retaining cap 15 which is screwed into the ends of cutting roll 20. The edges of blades 24 adjacent retaining cap 15 have a notch therein (unshown) which aligns with a groove (also unshown) in the end of cutting roll 20 for receipt of an annular protrusion (unshown) from retaining cap 15. As best seen in FIG. 4, blades 24 radially extend from cutting roll 20 and protrude from slots 21 slightly. The cutting edge of blades 24 is honed to be razor sharp.

Cutting roll 20 also has a plurality of radially extending projections, depicted as teeth 23 in FIG. 4. Teeth 23 extend radially from the normal periphery of roll 20 beyond the cutting edge of blades 24. There must be at least one tooth 23 on each side of a blade 24. Selected slots 21, however, may be left empty to alter the length of fiber cut. Teeth 23 are depicted as an integral part of cutting roll 20, and this is preferred. Teeth 23 and the portion of cutting roll 20 between blades 24 are made of a hard material, preferably metal, most preferably steel. Cutting roll 20 may be hollow or solid, preferably the latter, and preferably made of steel having a hardness of at least 20 on the Rockwell C Scale (ASTM E-18-61).

Pressure roll 25 is elastic in the sense that its yarn contacting surface or coating (see FIG. 4) is temporarily deformable by teeth 23 to a depth of at least the distance teeth 23 project from the surface of cutting roll 20. This portion of pressure roll 25 preferably has a range of 80 to 95 durometer on A scale of hardness, ASTM D-785. Polyurethane is the material of choice for the roll itself or a coating for the roll due to its wear characteristics. Cutting roll 20 and pressure roll 25 are forced into mesh with jack blocks and screws 16 (see FIG. 1); by into mesh is meant the relationship shown in FIG. 4.

Suitable covers and shields for cutter 10 may be provided along with guides for fiber access. Fiber strippers 17 (see FIGS. 1 and 2) are placed, one to the side of cutting roll 20 and one to the side of pressure roll 25, along the longitudinal axes thereof and 180° more or less from the cutting zone. Each fiber stripper 17 constitutes an air duct having a plurality of apertures facing the particular roll 20 or 25 adjacent thereto. Air is supplied to strippers 17 to blow off any fiber which tends to follow the rotating rolls 20 and 25 subsequent to cutting.

A guide system 18 is provided which comprises a plurality of spaced apart partitions, mounted directly above the cutting zone, for separating yarn ends being fed to cutter 10. The ends of yarn are segregated in system 18 to permit cutting of different types of fiber with a single cutting roll 20. That portion of a cutting blade which has been used for cutting fiberglass cannot be used to cut polyester without sharpening or coating the blade. This machine therefore permits cutting of different types of fiber by the same cutting blades of the cutter apparatus.

The following steps detail operation of cutter 10. The cutter cover is removed to permit string-up of guide system 18 wherein a yarn end is fed between each pair of partitions. The air supply is then cut on to fiber strippers 17. The motor is cut on, which ultimately results in rotation of cutting roll 20 and pressure roll 25. These rolls turn at about 50 to 1400 m/min, preferably 290 m/min. Yarn end 19 is compressed between tooth 23 and pressure roll 25 which then carry end 19 with them as they rotate through the cutting zone. With reference to FIG. 4, when the succeeding tooth 23 compresses yarn end 19 against pressure roll 25, the yarn end is tensioned between those two teeth and over the cutting edge of blade 24. As rolls 20 and 25 continue to rotate and the next succeeding tooth 23 engages roll 25 with yarn end 19 therebetween, the yarn is cut by blade 24. With reference to FIG. 4, the yarn is cut when blade 24 has rotated to the position of blade 24', which is the point of greatest deformation of roll 25. As can be seen, the tensioned yarn 19 is pressed between teeth 23 against the cutting edge of blade 24 to be cut thereby. As rotation continues, pressure roll 25 resumes its shape and the cut staple length falls into the resin paste below.

Thus, a first tooth 23 compresses yarn 19 as it engages polyurethane pressure roll 25. As the rolls rotate and the second tooth 23 compresses yarn 19 against polyurethane pressure roll 25, yarn 19 is stretched, or slightly tensioned between teeth 23 and across the cutting edge of blade 24. As rotation continues, blade 24 cuts yarn 19. The number of cutting blades 24 chosen is dependent upon the length of cut fiber desired. With reference to the shape of teeth 23, any shape that deforms pressure roll 25 without tearing yarn 19 is suitable, i.e., sharp teeth should not be used. It is preferred that teeth 23 be symmetrical as in FIG. 4 to permit the addition or deletion of blades therebetween for versatility in staple length.

Blades 24 preferably are made of steel; however, they may be made of tungsten carbide. In the preferred embodiment there is a six-inch (15 cm) pitch circle on gears 13 and 14, and thus on rolls 20 and 25. Teeth 23 project about 0.042 inch (0.107 cm) radially outward from the normal surface of roll 20. The cutting edge of blade 24 projects approximately 0.025 inch (0.064 cm) radially outward from the normal surface of roll 20. The preferred number of projections/teeth 23 and slots 21 is 76; with a blade 24 in each slot 21, 0.25 inch (0.64 cm) staple is cut. Blades 24 are centered between teeth 23. With 38 blades 24 in every other slot, 0.50 inch (1.23 cm) staple is cut. The number of partitions in guide system 18 is 25, for feeding 24 yarn ends.

Figure 5:
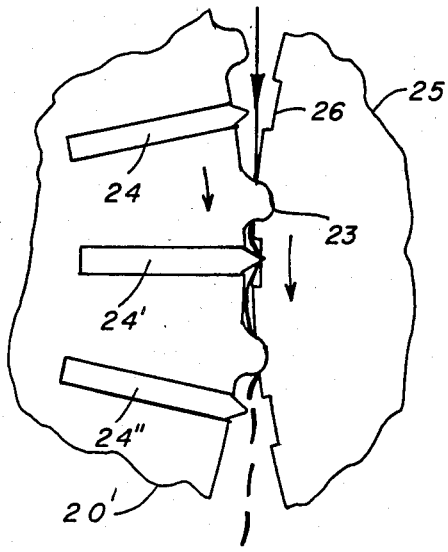
FIGS. 5 and 6 are detailed sectional views of alternate cooperating cutting rolls 20' and 20'', respectively, and pressure roll 25.

The embodiment depicted in FIG. 4 has proved satisfactory for cutting rolls 20 having a diameter as small as two inches (5 cm). An alternate and less preferred embodiment for cutting rolls 20 having a diameter of 2 to 4 inches (5 to 10 cm) is depicted in FIG. 5. There cutting roll 20' has a diameter of about 2.1 inches (5.4 cm) for use with handheld chopper guns cutting 0.25 inch (0.64 cm) staple. Notches 26 are provided in pressure roll 25 at spaced intervals which correspond to engagement of blades 24. This ensures that the second tooth 23 engages pressure roll 25 prior to yarn end 19 being cut. Notches 26 have a depth and arc length of 0.010 and 0.075 inch (0.025 and 0.191 cm), respectively, for this 2.1 inch (5.4 cm) cutting roll system. Further, teeth 23 project about 0.047 inch (0.119 cm) radially outward from the normal surface of roll 20'. The length from the center of blade 24 to the closest edge of tooth 23 (trailing blade 24) is about 0.060 inch (0.151 cm), i.e., blade 24 is not centered between teeth 23, but is much closer to the succeeding tooth 23.

Figure 6:
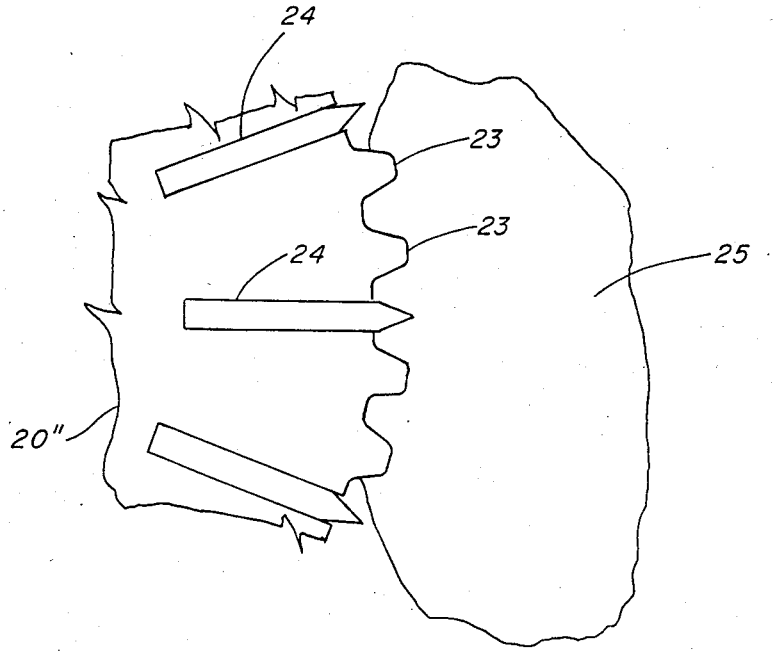

FIG. 6 depicts another cutter, used in a chopper gun producing handheld spray-up reinforced plastic molded parts. The leading and trailing tooth 23 for each blade 24 must be sufficiently close to the blade to achieve compression of the yarn 19 by both teeth 23 with pressure roll 25 simultaneously. It has been discovered that at least two teeth 23, as described above [approximately 0.047 inch (0.12 cm) width], are needed between blades 24 for a cutting roll 20'' having a diameter of 1.5 inches (3.8 cm) and used with a similarly sized pressure roll 25, for cutting 0.25 inch (0.64 cm) staple. This arrangement is believed to be necessary for cutter rolls 20'' having diameters of from about 1 inch (2.5 cm) up to 2 inches (5 cm) wherein a similar diameter pressure roll 25 is used. Preferred arrangement is a 1.5 inch (3.8 cm) pitch circle on gears 13 and 14, and thus on rolls 20'' and 25. Teeth 23 project about 0.05 inch (0.13 cm) radially outward from the normal surface of roll 20''. The cutting edge of blade 24 projects approximately 0.044 inch (0.11 cm) radially outward from the normal surface of roll 20''. The preferred number of projections or teeth 23 is thirty-six and slots 21 is eighteen (20° intervals center to center based on the longitudinal axis of roll 20''). Each tooth 23 is 0.047 inch (0.12 cm) in the direction of yarn travel. The center of a blade 24 to the center of its leading or trailing tooth 23 forms an angle of 6° with respect to the longitudinal axis of cutting roll 20''. Cutting roll 20'' and pressure roll 25 are geared together so that the same spot of pressure roll 25 is hit by a particular blade 24 on each revolution of rolls 20'' and 25. A single, larger tooth might work in lieu of two teeth 23 between blades 24 if the distance from that tooth to adjacent blades is maintained. Two sets of cooperating cutter and pressure rolls are preferably used in a single chopper gun with a barrier therebetween. Separate cutting chambers are thereby defined for polyester fiber and fiberglass. The chopped fibers mix together as they exit their respective chambers.

I claim:

1. In an apparatus for cutting elongated material into predetermined lengths comprising a rotatable cutting roll having a plurality of radially extending cutting blades, and a cooperating second roll, said rolls rotating in opposite directions and between which said elongated material passes, the improvement comprising: a plurality of projections radially extending from said cutting roll, at least one of said projections being located on each side of a cutting blade and extending further radially from said cutting roll than said blades, said second roll having an elastic material at its periphery which is engaged by said projections in succession to compress the elongated material therebetween.

2. The apparatus of claim 1 wherein there are at least two of said projections on each side of a cutting blade.

3. The apparatus of claim 2 wherein said rolls have substantially similar diameters ranging from about 1 to 2 inches (2.5 to 5 cm).

4. Apparatus for cutting elongated material into short lengths, comprising:

means for compressing the elongated material at discrete intervals;

means for tensioning the elongated material between said intervals; and means for pressing the slightly tensioned elongated material between said intervals against a cutting edge to ultimately cut said elongated material therewith; wherein said compressing means comprises a pair of rotatable rolls between which said elongated material passes, one of said rolls having a plurality of projections radially extending therefrom at said intervals, the other of said rolls being temporarily deformable by each of said projections along its periphery to compress said elongated material, said rolls being mounted for opposed rotation and with at least two of said projections in contact with and deforming the periphery of said other roll when at rest.

5. The apparatus of claim 4 wherein said tensioning means and said compressing means are the same, said elongated material being tensioned when compressed at two successive intervals between said projections and said other roll.

6. The apparatus of claim 4 wherein said cutting edge is mounted to radially extend from said roll with one of said projections on either side thereof, said projections radially extending from said roll a greater distance, than said cutting edge.

7. The apparatus of claim 6 wherein said pressing means comprises said other roll as the rolls rotate.

8. The apparatus of claim 4 wherein said cutting edge is mounted to radially extend from said roll with at least two of said projections on either side thereof, said projections radially extending from said roll a greater distance than said cutting edge.

9. The apparatus of claim 8 wherein said rolls have substantially similar diameters ranging from about 1 to 2 inches (2.5 to 5 cm).

10. The apparatus of claim 10 wherein the number of projections on either side of each cutting edge is two.

11. The apparatus of claim 10 wherein said pressing means comprises said other roll as the rolls rotate.

* * * * *